US008191981B2

(12) United States Patent
Arakawa

(10) Patent No.: US 8,191,981 B2
(45) Date of Patent: Jun. 5, 2012

(54) INK JET HEAD DRIVING APPARATUS

(75) Inventor: Hiroaki Arakawa, Uenohara (JP)

(73) Assignee: Konica Minolta Holdings, Inc., Tokyo (JP)

( * ) Notice: Subject to any disclaimer, the term of this patent is extended or adjusted under 35 U.S.C. 154(b) by 572 days.

(21) Appl. No.: 12/441,528

(22) PCT Filed: Aug. 30, 2007

(86) PCT No.: PCT/JP2007/066878

§ 371 (c)(1),
(2), (4) Date: Mar. 16, 2009

(87) PCT Pub. No.: WO2008/035553

PCT Pub. Date: Mar. 27, 2008

(65) Prior Publication Data

US 2010/0066776 A1 Mar. 18, 2010

(30) Foreign Application Priority Data

Sep. 20, 2006 (JP) ..... 2006-254740

(51) Int. Cl.
*B41J 29/38* (2006.01)

(52) U.S. Cl. ..... 347/10; 347/5; 347/9; 347/11; 347/12

(58) Field of Classification Search ..... 347/5, 9, 347/10–12
See application file for complete search history.

(56) References Cited

U.S. PATENT DOCUMENTS 5,172,134 A * 12/1992 Kishida et al. ..... 347/13
5,975,670 A * 11/1999 Kikuta et al. ..... 347/15
5,988,785 A * 11/1999 Katayama ..... 347/13
6,224,195 B1 * 5/2001 Maru et al. ..... 347/60
6,270,180 B1 * 8/2001 Arakawa et al. ..... 347/14
6,390,580 B1 5/2002 Anderson et al.
6,672,711 B2 * 1/2004 Kao et al. ..... 347/60
6,749,279 B2 * 6/2004 Kobayashi et al. ..... 347/14
7,125,105 B2 * 10/2006 Oomura ..... 347/58
7,182,421 B2 * 2/2007 Kobayashi et al. ..... 347/9
7,396,096 B2 * 7/2008 Kobayashi et al. ..... 347/11
7,441,859 B2 * 10/2008 Hayasaki ..... 347/17
8,052,239 B2 * 11/2011 Arakawa et al. ..... 347/9
2003/0214544 A1 11/2003 Aihara

FOREIGN PATENT DOCUMENTS

EP 0 900 657 A2 3/1999
JP 5-138900 A 6/1993
JP 7-060967 A 3/1995
JP 10-147010 A 6/1998
JP 2000-263770 A 9/2000

OTHER PUBLICATIONS

Extended European Search Report and Written Opinion dated Jan. 22, 2010 (in English) issued in a counterpart European Application No. 07806355.9-1251/2065197.

English Language International Search Report dated Sep. 25, 2007 issued in International Appln. No. PCT/JP2007/066878.

* cited by examiner

*Primary Examiner* — Laura Martin

*Assistant Examiner* — Jeremy Bishop

(74) *Attorney, Agent, or Firm* — Holtz, Holtz, Goodman & Chick, PC

(57) ABSTRACT

Provided is an ink jet head driving apparatus which can highly accurately control jetting timing separately for each of a plurality of nozzles of a head without increasing the number of signal lines and can change the jetting timing for each jetting cycle.

5 Claims, 5 Drawing Sheets

INK JET HEAD DRIVING APPARATUS

This application is a U.S. National Phase Application under 35 USC 371 of International Application PCT/JP2007/066878 filed on Aug. 30, 2007.

TECHNICAL FIELD

The present invention relates to an ink jet head driving apparatus, more in detail, relates to an ink jet head driving apparatus which enables high precision in the arrival position of jetted ink droplets by controlling a jetting-out timing for each of plural nozzles provided in the head.

BACKGROUND ART

Ink jet printers to make ink droplets to arrive onto a recording material by jetting the ink droplets from nozzles of a head have been used for recording images of characters, patterns, photographic pictures and the like. However, recent years, the study has been started to utilize the ink jet printers to various fields of manufacturing technology, such as the application for manufacturing color filters used for liquid crystal display devices and plasma display devices.

In connection with this study, the demands for the performance of ink jet printers has been increasing more, and also the demands for controlling jet-out timing finely with an accuracy less than a unit of one pixel independently for each nozzle has been increasing more. For example, in the manufacture of color filters, it is necessary to make each ink droplet of RGB to arrive to a predetermined position in many matrixes arranged longitudinally and transversely from nozzles of an ink jet head with an accuracy of an order of less than a unit of one pixel. For this reason, it is required to control the arrival position of ink droplet with high accuracy by adjusting it finely with an accuracy of an order of μm less than a unit of one pixel for each nozzle.

Further, Patent Document 1 discloses a recording apparatus capable of obtaining a high grade image. The recording apparatus is equipped with a delay time memory section to memorize for each dot a delay time preset beforehand corresponding to each of dot forming sections such as nozzles provided to a recording head, and the recording apparatus delays the supply of dot forming pulses to each dot forming section of the recording head on the basis of the delay time corresponding to each dot forming section read from this delay time memory section. In this structure, the delay time memory section is adapted to memorize an inclination error caused at the time of mounting a recording head so that the recording apparatus can output dots on a high accuracy condition without the inclination error for a recording medium and records such a high grade image.

Patent Document 1: Japanese Patent Unexamined Publication No. 2000-263770

DISCLOSURE OF THE INVENTION

Problems to be Solved by the Invention

Here, in order to control a jetting timing independently for each of nozzles, it is necessary in one head to connect a jetting start signal independently for each of nozzles.

However, usually, it is necessary to output serial clocks, serial data, and latch signals for data transfer and jetting start signals for producing driving waveform respectively from a control base board. For these signals, it is necessary to connect between the control board and the heads with a plurality of signal lines. Therefore, in order to control a jetting timing independently for each of nozzles as described above, since jetting start signal lines are needed to be connected by the number of nozzles, there is a problem that the number of signal lines becomes huge. If signals are arranged for each nozzle as described above, the arrangement makes the head into a large size, the wiring design complicated and the cost high. Under the circumstances that the number of heads and the number of nozzles are going to increase more in the future, it is an important theme to reduce the number of signal lines between a control base board and a head.

Moreover, as disclosed by Patent Document 1, a jetting timing is proposed to be changed for each nozzle by the technique to produce driving waveform after a delay time preset for each nozzle has elapsed from the timing of the same jetting start signal. However, in this case, there is a problem that since an ink droplet arrival position is shifted due to speed fluctuation of relative movement between a head and a recording material, it is difficult to make ink droplets to arrive to an exact position.

In addition, since the number of trigger signals is always one during one jetting cycle, an ink droplet arrival position cannot be adjusted to be less than a unit of one pixel. Further, since a delay time cannot be changed for each trigger signal, a jetting timing of each nozzle cannot be arbitrarily changed for each jetting cycle. As a result, there is a problem that a complicated printing or a pattern printing not having periodicity cannot be conducted.

Then, the present invention makes it a theme to provide an ink jet head driving apparatus which can control a jetting timing with high precision independently for each of plural nozzles of a head without increasing a number of signal lines and can change a jetting timing for each jetting cycle.

The other theme of the present invention will become clear by the following description.

Means for Solving the Problems

The above themes can be attained by the following invention.

The invention described in claim 1 is an ink jet head driving apparatus characterized by comprising:

a jetting timing signal output means for outputting a plurality of jetting timing signals for a plurality of nozzles respectively during one jetting cycle;

a count means adapted to be reset for each jetting cycle and for counting the jetting timing signals outputted for the plurality of nozzles respectively;

a first memory means for memorizing serially jetting data including synchronization information to indicate a timing to start jetting in synchronization with a jetting timing signal of what position of the plurality of jetting timing signals outputted from the jetting timing signal output means during one jetting cycle and non-jetting data for non-jetting for each of the plurality of nozzles;

a second memory means for latching and memorizing the data stored in the first memory means in synchronization with a signal generated at the stage that data for the plurality of nozzles have been memorized in the first memory means;

a comparing means provided for each of the plurality of nozzles and for inputting the count value of the count means and the data memorized by the second memory means and conducting outputting in the case that the synchronization information in the jetting data from the second memory means and the count value are coincident with each other; and a nozzle driving waveform producing means provided for each of the plurality of nozzles and for producing a nozzle driving waveform to jet in response to the outputting from the comparing means and outputting it to the nozzles.

The invention described in claim 2 is the ink jet head driving apparatus described in claim 1 and characterized in that the count means resets the count value in response to a signal related to a latch signal to latch the serial data memorized in the first memory means and to memorize the serial data in the second memory means.

The invention described in claim 3 is the ink jet head driving apparatus described in claim 1 or 2 and characterized in that the first memory means consists of shift registers having a plurality of 3 bit registers for the plurality of nozzles.

The invention described in claim 4 is an ink jet head driving apparatus characterized by comprising:

a jetting timing signal output means for outputting a plurality of jetting timing signals for a plurality of nozzles respectively during one jetting cycle;

a count means adapted to be reset for each jetting cycle and for counting the jetting timing signals outputted for the plurality of nozzles respectively;

a first memory means for memorizing serially jetting data including synchronization information to indicate whether to start jetting in synchronization with a jetting timing signal of what position of the plurality of jetting timing signals outputted from the jetting timing signal output means during one jetting cycle and non-jetting data for non-jetting for each of the plurality of nozzles;

a comparing means provided for each of the plurality of nozzles and for inputting the count value of the count means and the data memorized by the first memory means and conducting outputting in the case that the synchronization information in the jetting data from the first memory means and the count value are coincident with each other; and a nozzle driving waveform producing means provided for each of the plurality of nozzles and for producing a nozzle driving waveform to jet in response to the outputting from the comparing means and outputting it to the nozzles.

The invention described in claim 5 is the ink jet head driving apparatus described in claim 4 and characterized in that the first memory means consists of shift registers having a plurality of 3 bit registers for the plurality of nozzles.

Effect of the Invention

According to the present invention, it becomes possible to provide an ink jet head driving apparatus which can control a jetting timing with high precision independently for each of plural nozzles of a head without increasing a number of signal lines and can change a jetting timing for each jetting cycle.

EXPLANATION OF REFERENCE SYMBOLS

Figure 1:
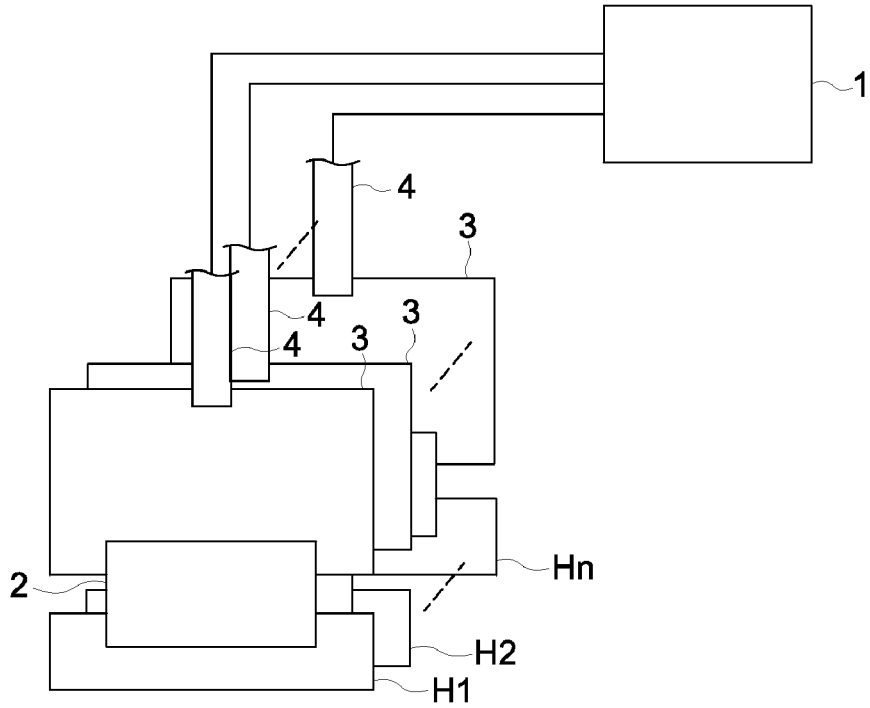
FIG. 1 is a structural view showing an outline of an ink jet head.

1: control base board
2: cable
3: driving section
31: counter
32: shift register
33: latch
34: comparator
35: driving waveform producing section
4: signal lines
H, H1, H2, . . . Hn: head
HU1, HU2 . . . Hun: head unit

BEST MODE FOR CARRYING OUT THE INVENTION

Hereafter, an embodiment of the present invention will be explained with reference to drawing.

FIG. 1 is a structural view showing an outline of an ink jet head, and H1, H2 . . . Hn represent a head respectively. The number of heads is not limited specifically in the present invention.

Each of the heads H1, H2 . . . Hn stores a liquid supplied from ink cartridges which is not illustrated and jets droplets from predetermined nozzles on the basis of predetermined signal given from the control base board 1 provided in common to the plural heads H1, H2 . . . Hn. The concrete structure of these heads H1, H2 . . . Hn includes, for example, a structure which employs electric-machine converting elements such as piezo elements and a structure which utilizes the blowout action of air bubbles generated at the time of heating liquid, and is not limited specifically as long as the structure can jet droplets on the basis of predetermined signals.

Each of the heads H1, H2 . . . Hn is connected by a cable 2 with respective driving sections 3 in which a driving IC to drive a corresponding one of the heads H1, H2 . . . Hn is mounted. The cables 2 and the driving sections 3 are accommodated together with the corresponding heads H1, H2 . . . Hn in respective casings being not illustrated so as to constitute respective head units. The driving section 3 of each of the head units is connected through a signal line 4, such as a flexible cable with a control base 1 board, respectively.

Figure 2:
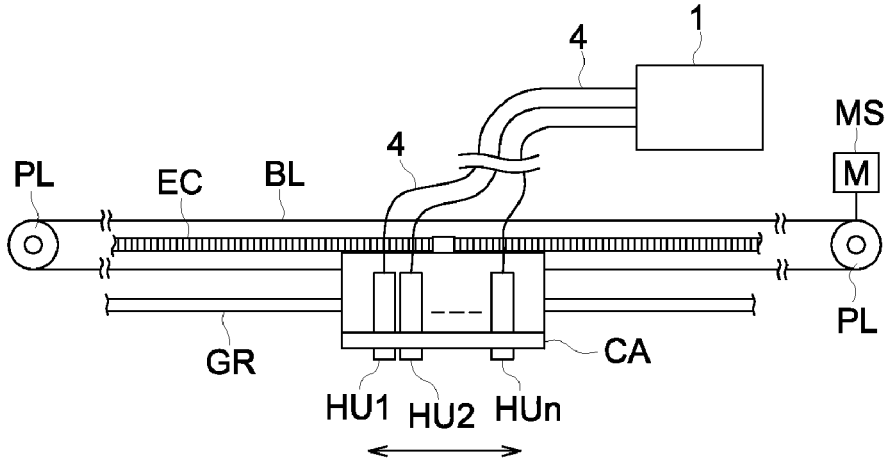
FIG. 2 is an outline structural view sowing one example of a printer.

FIG. 2 is an outline structural view showing an example of a printer on which the above head units are mounted.

Generally, the head units HU1 and HU2 . . . HUn are provided for each color, for example, such as YMCK or RGB, and these plural head units HU1 and HU2 . . . HUn are mounted on a common carriage CA. The carriage CA on which the head units HU1 and HU2 . . . HUn are mounted is arranged to be slidable on a guide rail GR so that the carriage can move outward and homeward along the main scanning direction of the printer shown by an arrowed mark with the guide of this guide rail GR.

The carriage CA is fixed to a belt BL being stretched over around two pulleys PL which are arranged with a predetermined interval in the main scanning direction, and when one of the pulleys PL is rotated by the driving of a main scanning motor MS, the belt BL is rotated, and the carriage CA is moved outward and homeward along the guide rail GR.

An encoder EC is arranged in parallel to the guide rail GR, and when the carriage CA moves outward and homeward along the main scanning direction, the position information of the carriage CA is adapted to be obtained as pulse signals.

And, during the period that the carriage CA is moving outward and homeward with a constant speed along the main scanning direction, each of the head units HU1, HU2 . . . HUn jets out droplets from predetermined nozzles with a predetermined timing so as to make the droplets to arrive onto a recording material being not illustrated in the drawing.

Figure 3:
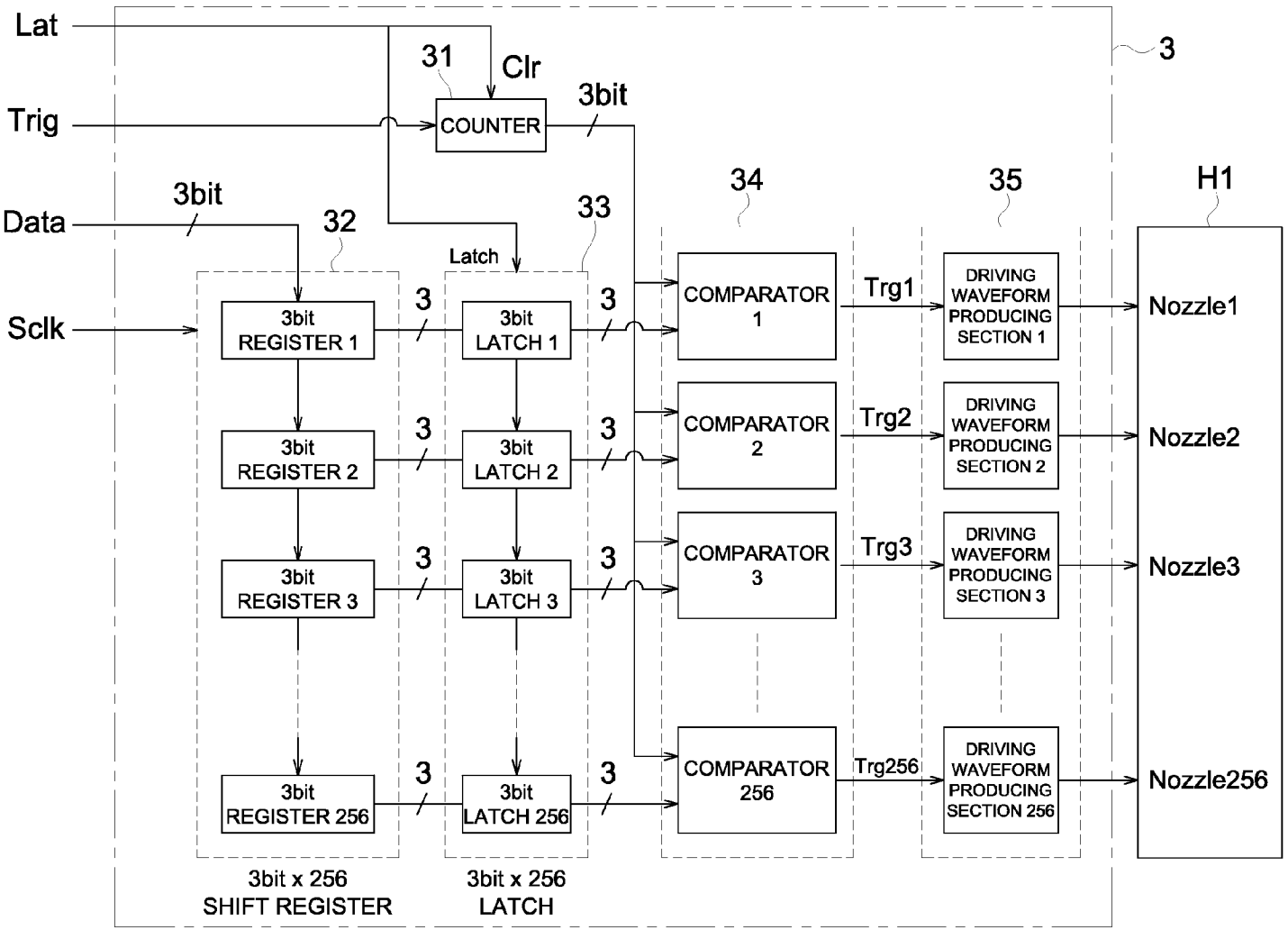
FIG. 3 is a block diagram showing a structure of a driving section of a driving apparatus of an ink jet head according to the present invention.

FIG. 3 is a block diagram showing an example of the driving section 3 of the above ink jet head. Here, since the driving section 3 of each of the head units HU1, HU2 . . . HUn has an identical configuration respectively, the structure of the driving section 3 in the head unit HU1 is explained here.

As shown in the drawing, the driving section 3 comprises a counter 31, a shift register 32, a latch 33, a comparator 34, and a drive waveform producing section 35.

The counter 31 is a counting section to count plural trigger signals (Trig) being jetting timing signals upon receipt of them sent from the control base board 1, and the counter 31 is provided in common to plural nozzles in one head H1. With regard to the plural nozzles, 256 nozzles of from Nozzle 1 to Nozzle 256 are explained here, if the nozzles are plural nozzles, the number of nozzles is not limited specifically. In this embodiment, seven pieces of information from "1" through "7" in count values consist of 3 bits respectively, and these count values are outputted to the comparators 34 provided for respective nozzles of Nozzle 1 through Nozzle 256 which are mentioned later.

Here, trigger signals (Trig) are produced on the basis of pulse signals obtained by the encoder EC to detect the position information, along the main scanning direction, of the carriage CA on which the plural head units HU1, HU2 . . . HUn are mounted as shown in FIG. 2. Therefore, the encoder EC also acts as a jetting timing signal output section in the present invention.

In FIG. 2, the encoder EC represents a linear encoder located along the main scanning direction of the carriage CA. However, the encoder EC may be a rotary encoder to obtain pulse signals from the rotation of the main scanning motor MS. In the present invention, it is preferable for the object of performing a jetting timing more finely to use an encoder capable of obtaining high fine pulse signals (10 kHz to 1 MHz) more than the jetting cycle of each of the heads HU1, HU2 . . . . Hun. As such an encoder, an incremental rotary type encoder can be used preferably.

The shift register 32 is a first memory section to store serial data (Data) which represents jetting or non-jetting of each nozzles of Nozzle 1 through Nozzle 256 provided in the head H1 and are transmitted in synchronization with serial clocks (Sclk) outputted from the control base board 1. This shift register 32 memorizes serial data (Data) corresponding in number to 256 pixels required to drive 256 nozzles of the head H during one jetting cycle (cycle to make it possible to conduct next jetting after jetting one time).

Each of 256 registers constituting the shift register 32 is constituted by 3 bits here respectively, and is adapted to memorize 3-bit serial data (Data) transmitted from the control base board 1.

When each register of the shift register 32 memorizes data of the corresponding nozzle and the serial data (Data) for all the 256 nozzles are stored, the data are latched by a latch signal (Lat) outputted with a constant interval from the control base board 1, and are stored in the latch 33 which is a second memory section.

This latch signal (Lat) is outputted with the constant interval corresponding to the jetting cycle of the head H1. On the other hand, the output of the trigger signal (Trig) is a signal having a frequency higher than the output of the latch signal (Lat). Therefore, the counter 31 counts plural trigger signals (Trig) during a period after a latch signal (Lat) is outputted until the following latch signal (Lat) is outputted. Here, the trigger signal (Trig) being a jetting timing signal in the present invention does not necessarily need to be outputted with a constant interval between these two latch signals (Lat).

The output of a latch signal (Lat) is simultaneously outputted also to the counter 31.

When the counter 31 receives an input of the signal related to the latch signal (Lat), the counter 31 resets the count value of the trigger signal (Trig) till then. Thus, with the structure that the count value of the counter 31 is reset by the signal related to the latch signal (Lat), the heads H1 and H2 . . . Hn can obtain synchronism to each other so as to start jetting at a trigger position set-up each time from a latch signal (Lat).

Here, a signal related to a latch signal (Lat) is not only the latch signal (Lat) itself but includes a signal generated by the latch signal (Lat).

The 3-bit serial data (Data) transmitted from the control base board 1 represents jetting data to make nozzles of Nozzle 1 through Nozzle 256 in the head H to jet droplets or non-jetting data to make them not to jet droplets. Further, the jetting data of the 3-bit serial data includes synchronization information to indicate whether to start jetting in synchronization with a trigger signal (Trig) of what position of plural trigger signals (Trig) outputted from the control base board 1 during one jetting cycle.

Figure 4:
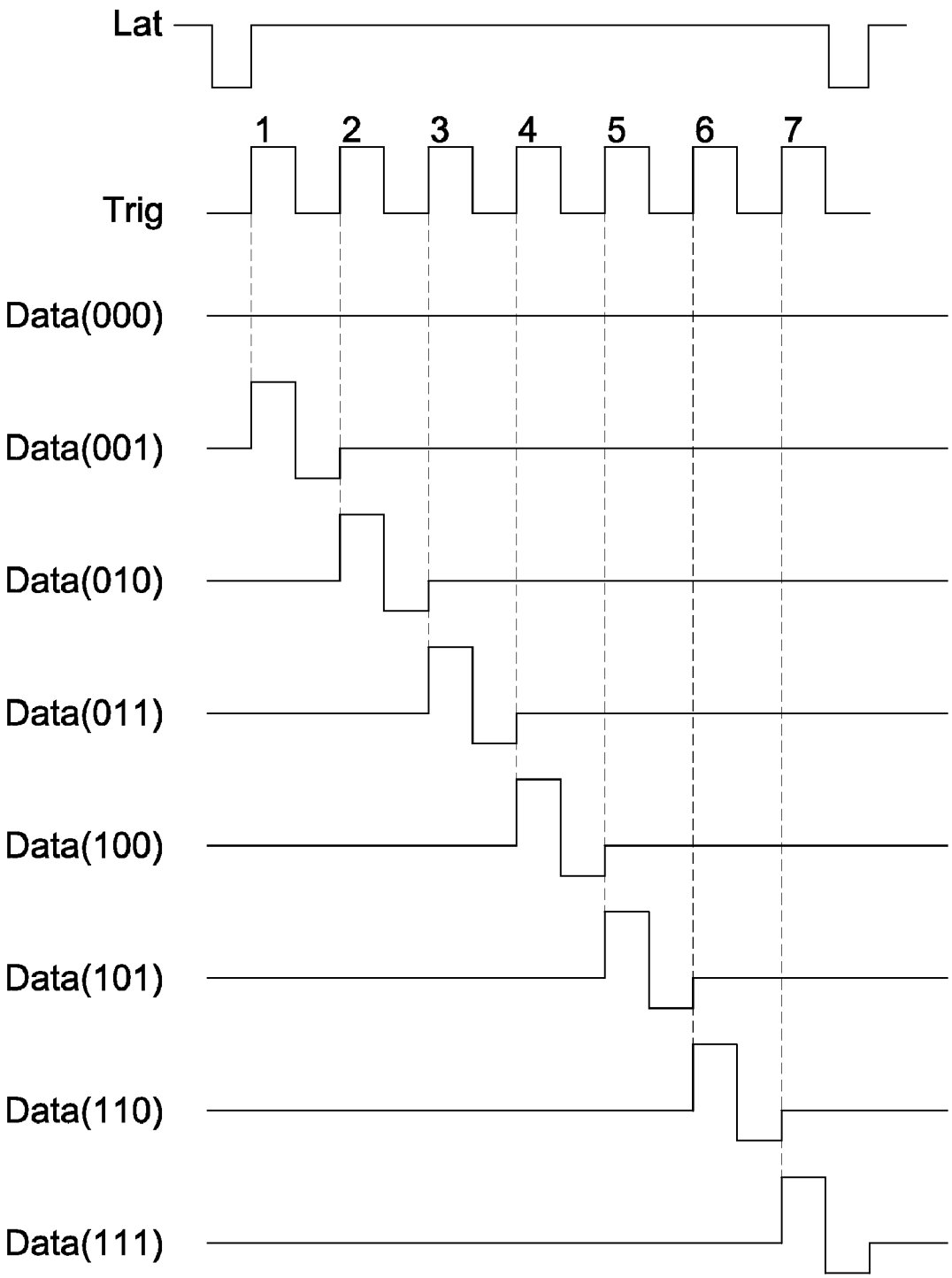
FIG. 4 is a timing chart of 3 bit serial data transmitted from a control base board.

FIG. 4 shows a timing chart of the 3-bit serial data (Data) transmitted from the control base board 1. The square waves indicated at the positions of seven data of Data (001) through Data (111) represent respectively a driving signal for driving nozzles so as to jet droplets.

Namely, the 3-bit serial data (Data) consist of 8 kind data of all Data (000) through Data (111). Among them, Data (000) serves as non-jetting data which does not make nozzles to jet droplets, and the remaining seven kinds of Data (001) through Data (111) serve as jetting data which make nozzles to jet droplets.

The jetting data of Data (001) through Data (111) include simultaneously the synchronization information to indicate whether to start jetting with synchronization with a trigger signal (Trig) of what position of plural trigger signals (Trig) among Trigl through Trig7 outputted during one jetting cycle, that is, between one latch signal (Lat) and its following latch signal (Lat). For example, Data (001) serves as jetting data including the synchronization information to start jetting in synchronization with the first trigger signal (Trig).

The above synchronization information is incorporated in the 3-bit serial data (Data) for each nozzle of Nozzle 1 through Nozzle 256 transmitted for each jetting cycle from the control base board 1. Therefore, the synchronization information can be made different for each nozzle of Nozzle 1 through Nozzle 256 and for each jetting cycle.

The data stored in the latches 33 are outputted in parallel to the comparators 34 provided for each nozzle of Nozzle 1 through Nozzle 256.

Into each of the comparators 34, 3 bit count values having counted trigger signals (Trig) are inputted from the counter 31 together with the 3 bit data outputted from the above-mentioned latches 33. Then, the comparators 34 compares the synchronization information in the 3 bit data outputted from the latches 33 with the count values. As a result of the comparison, when the synchronization information coincides with the count values, the comparators 34 output a jetting start signal (Trig—n) to drive waveform producing sections 35 which acts a head driving waveform producing section, respectively.

The drive waveform producing sections 35 are provided for the nozzles of Nozzle 1 through Nozzle 256, respectively, and the drive waveform producing sections 35 produce head drive waveform signals for driving the nozzles of Nozzle 1 through Nozzle 256 in response to the jetting start signal from the comparators 34, and makes the signals to shift their level up to a supply voltage required for driving nozzles of Nozzle 1 through Nozzle 256. The output of each of this drive waveform producing section 35 is connected to the corresponding one of the nozzles of Nozzle 1 through Nozzle 256 provided in the head H1 so that the nozzles of Nozzle 1 through Nozzle 256 are applied with a driving signal in accordance with the data respectively.

Figure 5:
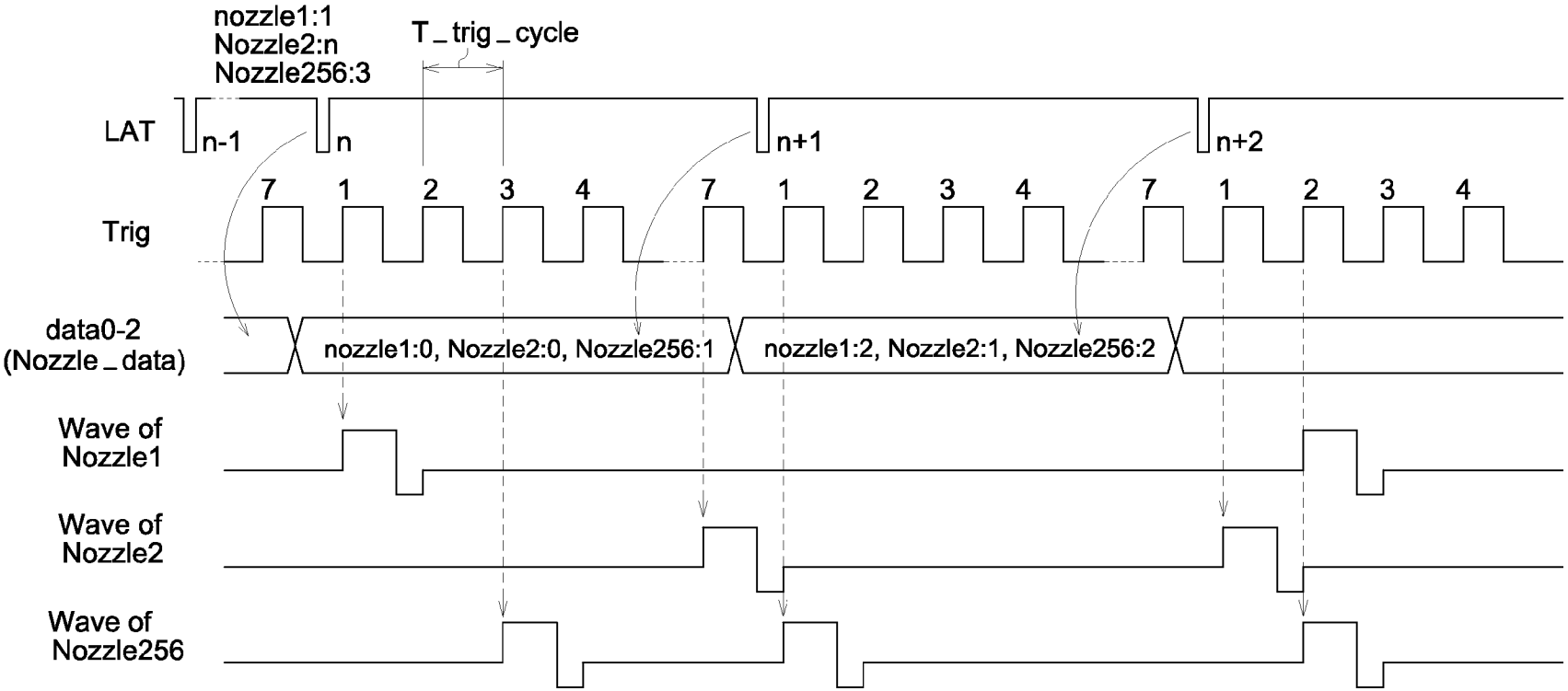
FIG. 5 is a timing chart showing a driving action of an driving apparatus of an ink jet head.

Next, the concrete drive operations of the ink jet head driving apparatus will be explained with reference to a timing chart shown in FIG. 5. In here, also the explanation will be made only about the head H1.

Here, from the control base board 1 to the driving section 3 of the head H1, trigger signals (Trig) corresponding to seven pulse waves are outputted during one jetting cycle. In the present invention, a trigger signal (Trig) to start jetting actually with the synchronization can be arbitrarily selected from a plurality of trigger signals (Trig) during one jetting cycle for each of the nozzles of Nozzle 1 through Nozzle 256 in one head H for each jetting cycle.

Now, attention is paid about three nozzles of Nozzle 1, Nozzle 2, and Nozzle 256, and it is supposed that in the jetting cycle latched by a latch signal (n), jetting data including the synchronization information are as follows:

Nozzle 1=1:Data (001)

Nozzle 2=7:Data (111)

Nozzle 256=3:Data (011), and in the jetting cycle latched by the next latch signal (n+1), jetting data including the synchronization information are as follows:

Nozzle 1=0:Data (000)—non-jetting data

Nozzle 2=0:Data (000)—non-jetting data

Nozzle 256=1:Data (001).

Now, if the latch signal (n) to form a break point between jetting cycles is outputted, serial data (Data) corresponding to the nozzles of Nozzle 1 through Nozzle 256 for one jetting cycle from the latch signal (n−1) to the latch signal (n) are shifted from the shift registers 32 and stored in the latches 33.

Then, the data stored in the latches 33 are sent to the comparators 34, and the synchronization information included in the data is compared with the count value of trigger signals (Trig) outputted between the latch signal (n) and the following latch signal (n+1) by the counters 31.

As a result of the comparison, if the synchronization information of the data sent from the latches 33 and the count value are coincident with each other, the comparators 34 output a jetting starting signal (Trig—n) to the corresponding drive waveform producing section 35. Namely, the jetting control is conducted in the following ways. For the Nozzle 1 among the data latched by the latch signal (n), a jetting starting signal is outputted in synchronization with the first trigger signal (Trig), and a driving signal is outputted to the Nozzle 1 from the corresponding drive waveform producing section 35. For the Nozzle 2, a jetting starting signal is outputted in synchronization with the seventh trigger signal (Trig), and a driving signal is outputted to the Nozzle 2 from the corresponding drive waveform producing section 35. For the Nozzle 256, a jetting starting signal is outputted in synchronization with the third trigger signal (Trig), and a driving signal is outputted to the Nozzle 256 from the corresponding drive waveform producing section 35.

Next, if the latch signal (n+1) to form a break point for the next jetting cycle is outputted, serial data (Data) corresponding to the nozzles of Nozzle 1 through Nozzle 256 for one jetting cycle from the latch signal (n) to the latch signal (n+1) are shifted from the shift registers 32 and stored in the latches 33.

Then, the data stored in the latches 33 are sent to the comparators 34, and the synchronization information included in the data is compared with the count value of trigger signals (Trig) outputted between the latch signal (n+1) and the following latch signal (n+2) by the counters 31.

As a result of the comparison, if the synchronization information of the data sent from the latches 33 and the count value are coincident with each other, the comparators 34 output a jetting starting signal (Trig—n) to the corresponding drive waveform producing section 35. Namely, the jetting control is conducted in the following ways. For the Nozzle 1 and Nozzle 2 among the data latched by the latch signal (n+1), since the data represent non-jetting data, a jetting start signal is not outputted. For Nozzle 256, a jetting starting signal is outputted in synchronization with the first trigger signal (Trig), and a driving signal is outputted to the Nozzle 256 from the corresponding drive waveform producing section 35.

Similarly, jetting or non-jetting is controlled on the basis of 3 bit data for each of the nozzles of Nozzle 1 through Nozzle 256 for each jetting cycle between a latch signal (Lat) and the following latch signal (Lat).

Thus, whether to start jetting in synchronization with a trigger signal of what position during one jetting cycle can be made to change for each of the nozzles of Nozzle 1 though. Nozzle 256 in one head H for each jetting cycle. Therefore, a jetting timing can be set finely for each of the nozzles of Nozzle 1 though Nozzle 256 for each jetting cycle without the dependency for the maximum jetting frequency. As a result, an arrival position of droplets can be controlled more precisely.

Further, it is not necessary to connect signal lines of trigger signals to each of plural nozzles of Nozzle 1 though Nozzle 256 in one head H in order to control a jetting timing finely for each of the nozzles of Nozzle 1 though Nozzle 256 in one head H. Therefore, there is no increase in the number of signal lines to connect the control base board 1 with the driving sections of the head H. With this, it is possible to eliminate the problems of a large sized head, a complicated wiring design and a high cost.

Here, in this embodiment, in order to output seven trigger signals (Trig) during one jetting cycle, the counter 31, the shift register 32, and the latch 33 of the driving section 3 are constituted with 3 bits. However, the number of bits can be set appropriately in accordance with the number of trigger signals (Trig) outputted during one jetting cycle. According to the present invention, it can be easily understood that if the number of bits utilized for data is made more, a jetting timing can be controlled more finely.

Next, another embodiment will be described with reference to FIG. 6.

Figure 6:
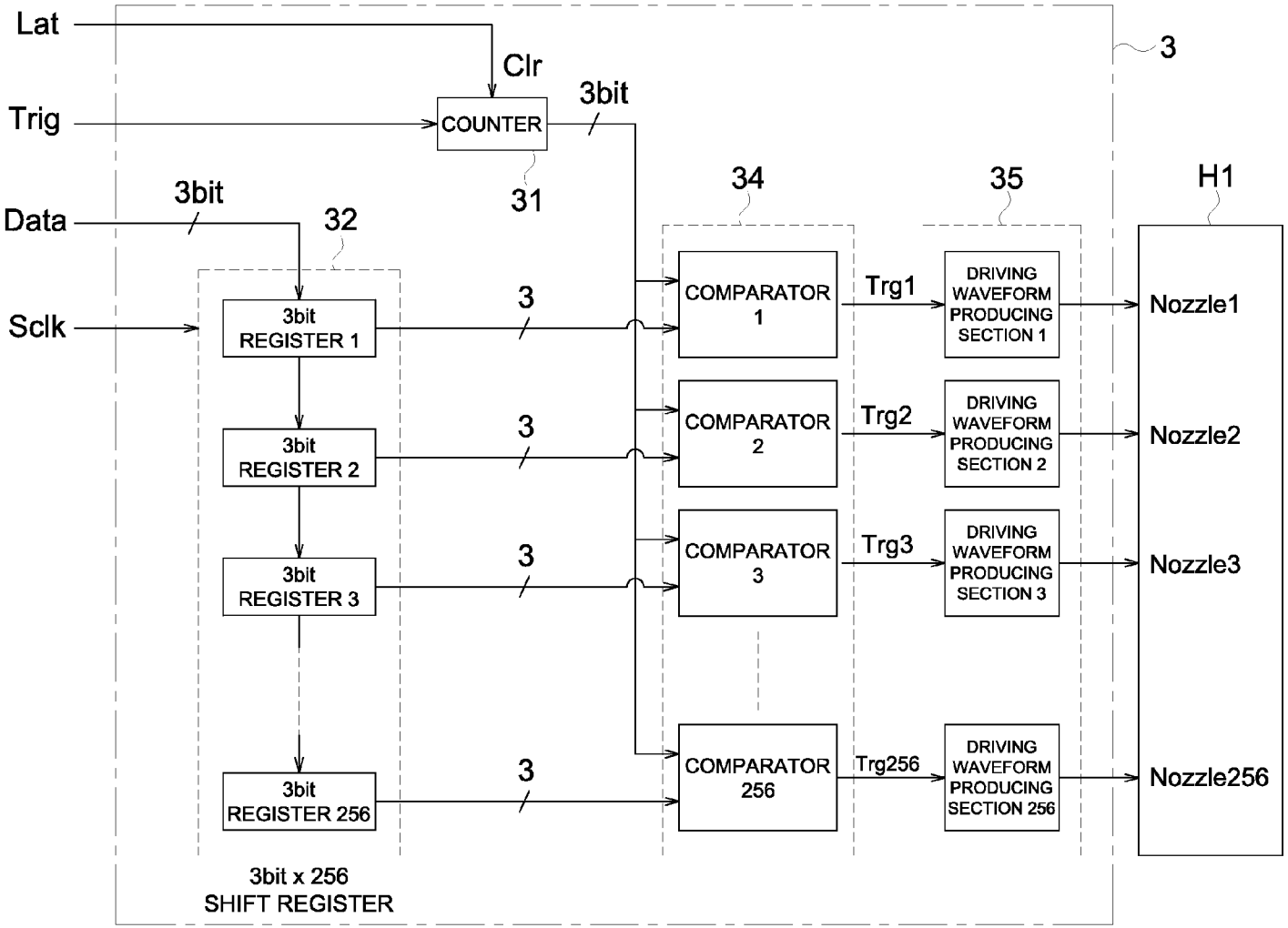
FIG. 6 is a block diagram showing another structure of a driving section of a driving apparatus of an ink jet head according to the present invention.

FIG. 6 shows the modified example of the driving section shown in FIG. 3. That is, FIG. 6 shows an example structured such that the latch being the second memory section in FIG. 3 is omitted. In FIG. 6, the components with the same number as the components in FIG. 3 is the same structure of the components.

In FIG. 6, at the time of starting an ink jetting action by a head H, firstly, in synchronization with serial clocks (Sclk), serial data (Data) of jetting or non-jetting for each nozzle of Nozzle 1 through Nozzle 256 are inputted into shift registers 32 sequentially, and stored in the shift registers 32. At the stage that the input for all of 256 registers has finished, the input of serial clocks (Sclkk) is stopped and the contents of the registers are fixed.

On this condition, the above first memory section becomes the same condition as the second memory section. Next, if a latch signal (Lat) outputted with the constant interval corresponding to the jetting cycle of a head H1 is inputted into a counter 31, the previous count values of trigger signals (Trig) are reset. Each of data in the registers is compared with the count values of trigger signals by each of comparators, and when the data are coincide with the count values, a jetting start signal is outputted to a corresponding drive waveform producing section. This period becomes an ink jetting period.

At the stage that the ink jetting period has finished, the data input to this shift register 32, i.e., serial clocks (Sclk) are released, and it becomes the condition that the following data can be inputted.

Next, serial data (Data) for each nozzle of Nozzle 1 through Nozzle 256 for the following one jetting cycle are stored in the shift registers 32.

In this example, during the period that data input are conducted for the first memory section, jetting ink from the head 1 cannot be conducted. However, when the period that data input is being conducted, that is, a data transfer period is very short in comparison with the ink jetting period, this embodiment is especially effective. Namely, the almost same effect can be expected without comprising the second memory section.

The above-explained ink jet head driving apparatus can be applicable not only to a printer used generally for image formation, but also to various fields of manufacturing technique required to make droplets to arrive a target position precisely by controlling jetting droplets finely from each head or each nozzle. Especially, the above-explained ink jet head driving apparatus can be preferably applicable as an ink jet head driving apparatus mounted on a printer used for manufacturing color filters usable for a liquid crystal display apparatus, a plasma display and the like.

The invention claimed is:

1. An ink jet head driving apparatus for controlling a jetting timing independently for each of a plurality of nozzles of a head, the ink jet head driving apparatus comprising:

a jetting timing signal outputting section to output sequentially a plurality of jetting timing signals different in sequential order during one jetting cycle;

a data holding section to hold pixel data including one of jetting data and non-jetting data for each of the plurality of nozzles, wherein the jetting data include synchronization information designating a position in the sequential order of the plurality of jetting timing signals as a timing to start jetting during one jetting cycle;

a plurality of comparing sections each provided to correspond to one of the plurality of nozzles, to receive the pixel data of a corresponding nozzle from the data holding section and the plurality of jetting timing signals sequentially from the jetting timing signal outputting section, to compare a position designated by the synchronization information of the jetting data of the pixel data with respective positions of the plurality of jetting timing serial signals sequentially, and to output a jetting signal when the position designated by the synchronization information and one position of the respective positions of the plurality of jetting timing signals are coincident in sequential order with each other; and a plurality of nozzle driving signal producing sections each provided to correspond to one of the plurality of nozzles, to produce a nozzle driving signal to conduct jetting in response to the jetting signal from the comparing section, and to output the nozzle driving signal to the corresponding nozzle.

2. The ink jet head driving apparatus described in claim 1, wherein the data holding section comprises a shift register to hold the pixel data serially for each of the plurality of nozzles and a latch section to shift a plurality of the pixel data from the shift register upon receipt of a latch signal generated when the data holding section have held the plurality of the pixel data corresponding to the plurality of nozzles and to transmit the plurality of the pixel data in parallel to the plurality of comparing sections.

3. The ink jet head driving apparatus described in claim 2, further comprising:

a count section to transmit the plurality of jetting timing signals sequentially from the jetting timing signal outputting section to the plurality of comparing sections.

4. The ink jet head driving apparatus described in claim 3, wherein an action of the count section to transmit the plurality of jetting timing signals sequentially is reset in accordance with the latch signal.

5. The ink jet head driving apparatus described in claim 1, wherein the pixel data are 3 bit data.

* * * * *